US008286687B2

(12) United States Patent
Bosgoed

(10) Patent No.: US 8,286,687 B2
(45) Date of Patent: Oct. 16, 2012

(54) DEVICE FOR CLOSING AND OPENING CURTAINS

(75) Inventor: Henricus Wilhelmus Frederikus Bosgoed, Schalkhaar (NL)

(73) Assignee: Forest Group Nederland B.V. (NL)

( * ) Notice: Subject to any disclaimer, the term of this patent is extended or adjusted under 35 U.S.C. 154(b) by 0 days.

(21) Appl. No.: 12/774,085

(22) Filed: May 5, 2010

(65) Prior Publication Data

US 2011/0168341 A1 Jul. 14, 2011

(30) Foreign Application Priority Data

May 12, 2009 (NL) ..... 1036947

(51) Int. Cl.
*A47H 5/02* (2006.01)

(52) U.S. Cl. ..... 160/331; 160/345

(58) Field of Classification Search ..... 160/331, 160/346, 347, 345
See application file for complete search history.

(56) References Cited

U.S. PATENT DOCUMENTS

| | | | | |
|---|---|---|---|---|
| 3,341,885 A | | 9/1967 | Johnson | |
| 3,753,457 A | | 8/1973 | Bratschi | |
| 4,492,262 A | * | 1/1985 | Comeau | 160/126 |
| 4,548,250 A | | 10/1985 | Meharg et al. | |
| 6,024,156 A | * | 2/2000 | Chu | 160/331 |
| 6,994,145 B2 | * | 2/2006 | Killo et al. | 160/331 |
| 7,686,064 B2 | * | 3/2010 | Gu | 160/341 |
| 2011/0168341 A1 | * | 7/2011 | Bosgoed | 160/331 |

FOREIGN PATENT DOCUMENTS

EP 1316281 A1 6/2003

* cited by examiner

*Primary Examiner* — Blair M. Johnson
(74) *Attorney, Agent, or Firm* — Laubscher & Laubscher, P.C.

(57) ABSTRACT

A device for closing and opening curtains, which are movable along a rod (1), said rod near its ends being provided with a means for limiting the movement of said curtains. The rod (1) is provided with channels (2) in which an endless toothed belt (3) is received which at the ends of said rod (1) is guided by toothed wheels (7,13) from which one can be driven. Said toothed belt (3) is provided with at least one carrier (4) which can be connected to a curtain and can extend it self downwards through a slot (5) in said rod (1). A connector element (11) is provided which is connected to the rod (1) and extends substantially in line with this and comprises a sideways extending housing (10), in which said drivable toothed wheel (7) is present. The driving of said toothed wheel (7) takes place by means of an electric motor (9), which can be operated by means of a hand switch either by means of a time switch either by means of a light sensor.

4 Claims, 2 Drawing Sheets

DEVICE FOR CLOSING AND OPENING CURTAINS

BACKGROUND OF THE INVENTION

The invention relates to a device for closing and opening curtains, which are movable along a rod, the rod near its ends being provided with a device for limiting the movement of the curtains.

In many cases such a device is formed by cords extending along the rod and being guided by rollers. At least at one end of the rod the cords either one cord is running downwards so that the system can be manually operated for closing and opening the curtains.

Such a device might fail by the fact that the cords might be entangled and also might become worn.

Now the object of the invention is to provide a device 15 which has a simple construction and which can be operated in a simple way too.

SUMMARY OF THE INVENTION

According to the invention the device comprises a rod provided with channels in which an endless toothed belt can be received which at both ends of the rod is guided by toothed wheels from which one can be driven, the belt being provided with at least one carrier which can be connected to a curtain and can extend itself downwards through a slot in the rod.

In connection with the necessary driving the endless toothed belt can be curved away out of the channels near at least one of both ends of the rod and can be guided over the toothed wheel which can be driven.

When only one curtain has to be moved one carrier will suffice. In many cases two curtains have to be moved towards and away from each other. In that case each part of the toothed belt will have been provided with a carrier.

According to an embodiment of the invention a connector element is provided which is connected to the rod and extends substantially in line with this and comprises a sideways extending housing, in which the drivable toothed wheel is present.

The housing will extend itself substantially vertical downwards and, as seen in top view, it will be present beside the rod. Possibly it might be used also for connecting the rod to a part of the construction of a building.

In particular the driving of the toothed wheel will take place by way of an electric motor, which can be operated by way of a hand switch or in another way.

The electric motor can also be operated by way of a time switch either by a sensor sensing the amount of light near the sensor or an electronic circuit provided between the sensor and the switch.

In this way it can be obtained, that the curtain is closed and opened again at a given point of time either during a given period of the day. By this it will not be clear for the environment that no persons are present in the related apartment.

When a sensor is used the electronic circuit can be executed such, that after operating the switch a next operation can only take place after a given period.

By this it can be prevented that in case if a varying elucidation of the sensor, as in case of varying clouds, the curtains should be operated shortly after each other, so e.g. being closed and shortly after this being opened again.

Nevertheless the hand switch can be used also when one want to close or open the curtains at other points of time. In that case the other device might be switched off for some time.

BRIEF DESCRIPTION OF THE FIGURES

The invention is further elucidated with the help of an embodiment, shown in the accompanying drawing, in which.

DETAILED DESCRIPTION

Figure 2:
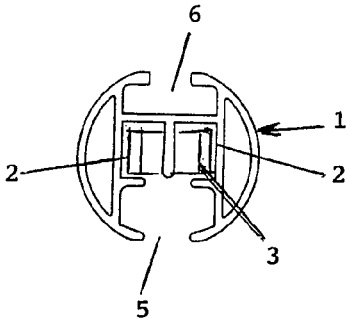
FIG. 2 shows a cross section over the line II-II of FIG. 1 of only the rod and the toothed belt present in it.

As shown in the figures the device comprises a rod 1, the cross section of which is shown in FIG. 2. As appears from this the rod comprises, among others, two channels 2 lying beside each other, in which is received an endless toothed belt 3, in particular shown in FIG. 4.

Figure 1:
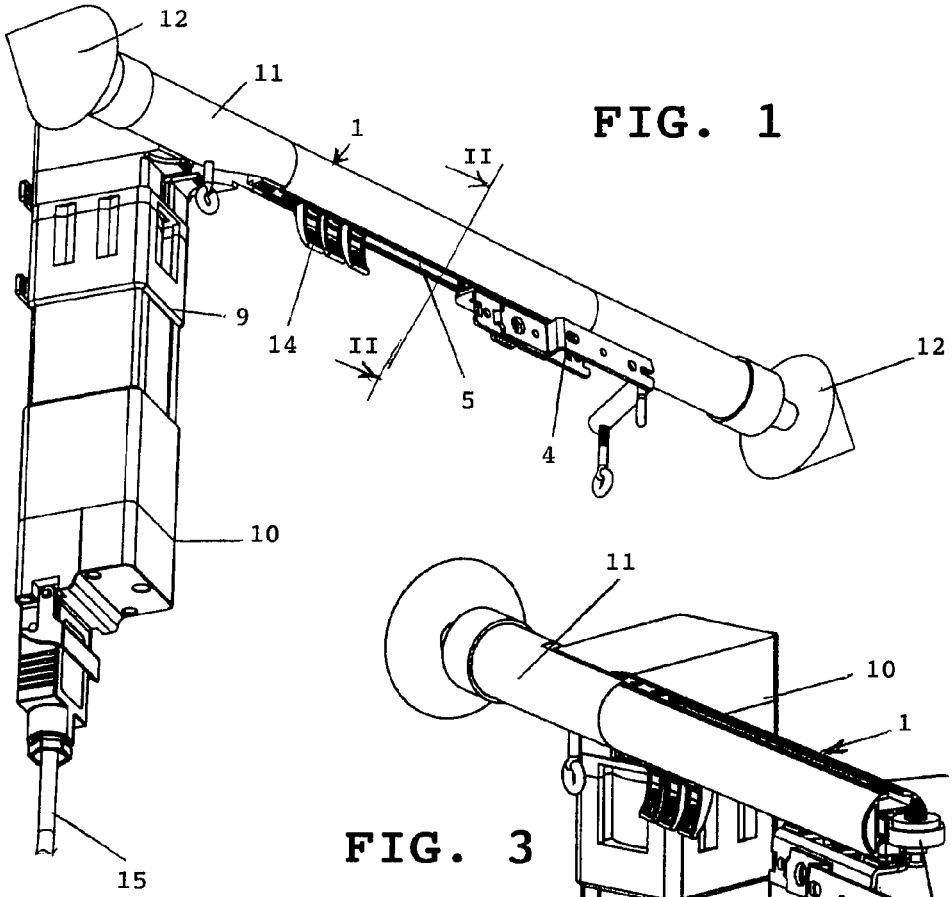
FIG. 1 shows a perspective view of a device according to the invention, as seen at an oblique angle from below.
Figure 3:
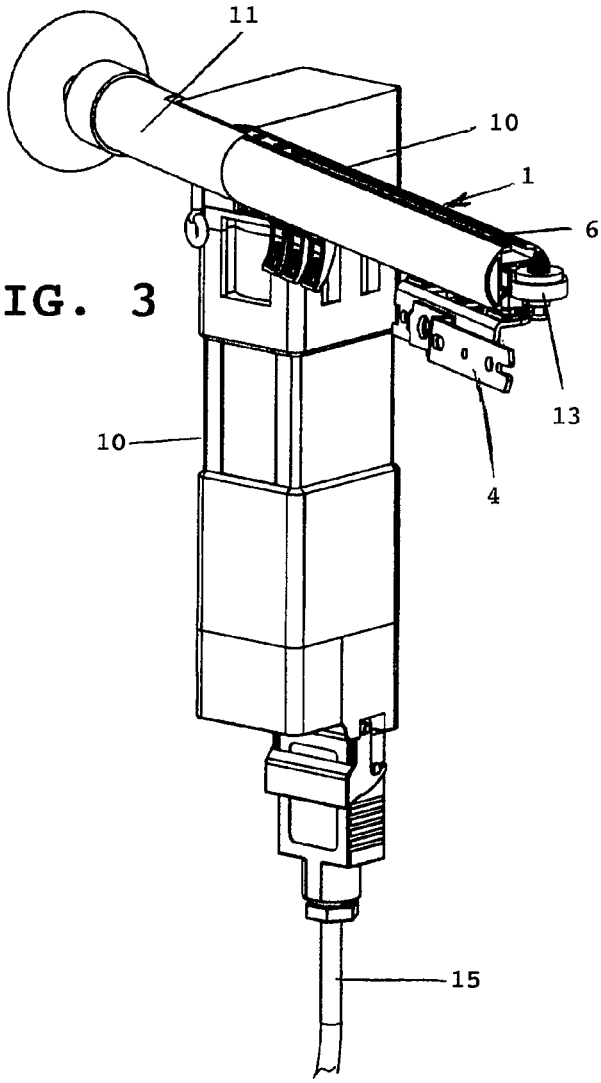
FIG. 3 shows a perspective view of a part of the device of FIG. 1 but seen from another angle.

The endless belt 3 can be fabricated as such. In particular, however, it will be formed by a piece of toothed belt from which the ends are connected to each other by a connector, forming part of a carrier 4, as shown in FIGS. 1 and 3. The carrier 4 includes forerunner.

In this way the desired length of the circumference of the toothed belt can be simply obtained and can be adapted to the length of the rod.

When two curtains, not further shown, have to be moved the toothed belt might comprise two parts, which are connected to each other by means of two connectors, each forming a part of a carrier 4.

The carriers 4, together with the forerunners, extend downwards from the connector part through the slot 5 of the rod 1, the rod further being provided with the slot 6 serving for receiving apparatus (not shown) by which the rod might be connected to a ceiling or a wall.

Figure 4:
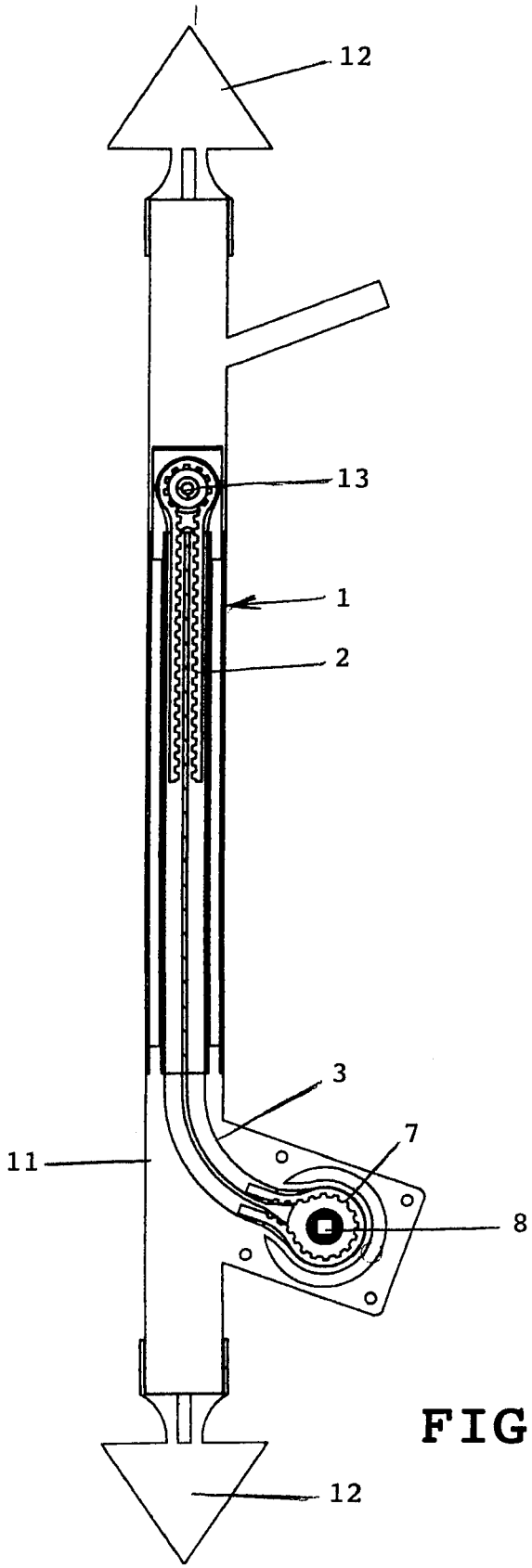
FIG. 4 schematically shows a top view of the device of FIG. 1, in which some parts are omitted for showing details.

As in particular shown in FIG. 4 near one end of the rod 1 the toothed belt 3 is running out of the channels 2 towards a toothed wheel 7, fixedly connected to the shaft 8. The shaft 8 might be driven by means of an electric motor 9, received in a housing 10 which, in view of the mounting of the various parts, will be provided with a removable lid. In FIG. 4 this lid is omitted for showing the course of the toothed belt 3 over the toothed wheel 7.

A transformer can be present in the housing 10 for delivery of current to the electric motor 9 with a voltage lower than that of the network.

The housing 10 might form part of a connector element 11, which can be connected to the rod 1, as by parts (not shown) which might engage one another and if necessary by other connecting elements. A closure 12 might be connected to the connector element 11. Such a closure 12 might also be mounted at the other end of the rod 1.

As shown in the FIGS. 3 and 4 near the end of the rod 1 the toothed belt 3 is guided over a toothed wheel 13, positioned inside the rod 1. It is not necessary to drive this toothed wheel 13. Obviously it is possible to mount the toothed wheel 13 in the same way as the toothed wheel 7, the wheel then being loosely rotatable on a shaft.

Further the housing 10 is provided with end switches 14 and with a current supply conductor 15 for supplying current to the electric motor 9. In the conductor 15 a hand switch can be mounted and possibly a time switch and a light sensor as mentioned above.

It will be obvious that only one possible embodiment of a device according to the invention is shown in the drawing and is described above and that many modifications can be applied without leaving the inventive idea.

The invention claimed is:

1. A device for closing and opening a curtain, comprising (a) a hollow rod having a longitudinal axis and containing a pair of channels and a slot in a lower surface thereof;

(b) a connector connected with one end of said rod and extending coaxially with said rod, said connector including a housing intermediate the ends thereof and extending laterally therefrom, said housing containing a first toothed wheel offset from said rod longitudinal axis and driven for rotation relative to said connector;

(c) a second toothed wheel rotatably connected with another end of said rod;

(d) an endless toothed belt connected with said first and second toothed wheels extending within said rod channels and into said housing; and (e) at least one carrier connected with said toothed belt and extending through said slot, the curtain being connected with said carrier, whereby when said driven wheel is operated, said endless toothed belt displaces said carrier relative to said rod between said first and second toothed wheels to open and close the curtain without interference from said housing.

2. A device according to claim 1, and further comprising an electric motor for driving said first toothed wheel.

3. A device according to claim 2, wherein said electric motor is operated by one of a timer switch and a photosensor.

4. A device according to claim 1, wherein said endless toothed belt is formed by a piece of toothed belt having ends connected to each other via a connector forming part of the carrier.

* * * * *